US009373296B2

(12) United States Patent
Lee et al.

(10) Patent No.: US 9,373,296 B2
(45) Date of Patent: Jun. 21, 2016

(54) DISPLAY APPARATUS

(71) Applicant: Samsung Display Co., Ltd., Yongin (KR)

(72) Inventors: Neung-Beom Lee, Gwangmyeong-si (KR); Jeong-Hyun Kim, Cheonan-si (KR); Jinseuk Kim, Cheonan-si (KR); Jong Hyun Sim, Busan (KR); Junpyo Lee, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 39 days.

(21) Appl. No.: 14/294,924

(22) Filed: Jun. 3, 2014

(65) Prior Publication Data

US 2015/0116385 A1 Apr. 30, 2015

(30) Foreign Application Priority Data

Oct. 30, 2013 (KR) ..... 10-2013-0130454

(51) Int. Cl.
*G09G 1/00* (2006.01)
*G09G 3/36* (2006.01)

(52) U.S. Cl.
CPC ..... *G09G 3/3659* (2013.01); *G09G 3/3607* (2013.01); *G09G 2300/0426* (2013.01); *G09G 2300/0447* (2013.01); *G09G 2300/0478* (2013.01); *G09G 2310/0251* (2013.01); *G09G 2310/0286* (2013.01); *G09G 2320/028* (2013.01)

(58) Field of Classification Search
CPC ..... G02F 1/1362; G02F 1/1368; G02F 1/136; G02F 1/1343; G09G 3/36; G09G 5/00
See application file for complete search history.

(56) References Cited

U.S. PATENT DOCUMENTS

| | | | | |
|---|---|---|---|---|
| 7,206,005 | B2 | 4/2007 | Yamashita et al. | |
| 7,548,285 | B2 | 6/2009 | Su et al. | |
| 7,948,470 | B2 | 5/2011 | Tsou et al. | |
| 8,411,007 | B2 | 4/2013 | Chen et al. | |
| 2012/0206327 | A1 | 8/2012 | Hsu | |
| 2013/0069855 | A1 | 3/2013 | Nakanishi et al. | |
| 2013/0069921 | A1 | 3/2013 | Saitoh | |
| 2013/0077031 | A1 | 3/2013 | Kim et al. | |
| 2013/0082915 | A1 | 4/2013 | Nakagawa | |
| 2013/0083263 | A1 | 4/2013 | Kim et al. | |
| 2013/0088476 | A1 * | 4/2013 | Yamagishi | G09G 3/3648 345/211 |
| 2013/0088681 | A1 * | 4/2013 | Hisada | G02F 1/134336 349/144 |

FOREIGN PATENT DOCUMENTS

| | | |
|---|---|---|
| JP | 2011-059204 | 3/2011 |
| KR | 10-2011-0138006 | 12/2011 |

* cited by examiner

*Primary Examiner* — Michael Faragalla
(74) *Attorney, Agent, or Firm* — H.C. Park & Associates, PLC

(57) ABSTRACT

A display apparatus includes pixels each including first and second sub-pixels having different transmittances from each other under a same gray scale, gate lines commonly connected to the first and second sub-pixels to apply a gate signal to the first and second sub-pixels, a first data line applying a first data signal to one of the first and second sub-pixels, and a second data line applying a second data signal to the other one of the first and second sub-pixels. The first sub-pixel has the transmittance lower than the transmittance of the second sub-pixel, and the second sub-pixel connected to an i-th gate line of the gate lines is disposed between the first sub-pixel connected to the i-th gate line and the first sub-pixel connected to an (i+1)th gate line of the gate lines.

20 Claims, 12 Drawing Sheets

DISPLAY APPARATUS

CROSS REFERENCE TO RELATED APPLICATION

This application claims priority from and the benefit of Korean Patent Application No. 10-2013-0130454, filed on Oct. 30, 2013, which is hereby incorporated by reference for all purposes as if fully set forth herein.

BACKGROUND

1. Field

Exemplary embodiments of the present disclosure relate to a display apparatus. More particularly, exemplary embodiments of the present disclosure relate to a display apparatus having improved display quality and charging rate.

2. Discussion of the Background

In general, a liquid crystal display includes a gate driving circuit to sequentially apply gate pulses to gate lines and a data driving circuit to apply pixel voltages to data lines.

Recently, a liquid crystal display including a pixel having two sub-pixels in order to improve a narrow viewing angle has been developed. The two sub-pixels respectively include a main pixel and a sub-pixel, which are applied with different sub-voltages, in order to form domains having different gray scales in the pixel. Since a viewer who watches the liquid crystal display recognizes an intermediate value between the two sub-voltages, a gamma curve is prevented from being distorted under an intermediate gray scale and a side viewing angle is prevented from being lowered. Accordingly, a side visibility of the liquid crystal display is improved.

The liquid crystal display generally employs a two-transistor type driving scheme. The two-transistor type driving scheme applies main and sub pixel voltages having different voltage levels to the main and sub pixel electrodes, respectively, using two transistors turned on at different times.

SUMMARY

Exemplary embodiments of the present invention provide a display apparatus capable of improving display quality and charging rate.

Additional features of the invention will be set forth in the description which follows, and in part will be apparent from the description, or may be learned by practice of the invention.

An exemplary embodiment of the present invention discloses a display apparatus including a plurality of pixels, each including first and second sub-pixels having different transmittances from each other under a same gray scale, a plurality of gate lines commonly connected to the first and second sub-pixels to apply a gate signal to the first and second sub-pixels, a first data line that applies a first data signal to one of the first and second sub-pixels, and a second data line that applies a second data signal to the other one of the first and second sub-pixels.

An exemplary embodiment of the present invention also discloses a display apparatus including a plurality of pixels, each including first and second sub-pixels having different transmittances from each other under a same gray scale, a plurality of gate lines commonly connected to the first and second sub-pixels to apply a gate signal to the first and second sub-pixels, a first data line that applies a first data signal to one of the first and second sub-pixels, and a second data line that applies a second data signal to the other one of the first and second sub-pixels.

The first sub-pixel has the transmittance lower than the transmittance of the second sub-pixel, and the first sub-pixel connected to an i-th gate line of the gate lines is disposed between the second sub-pixel connected to the i-th gate line and the second sub-pixel connected to an (i+1)th gate line.

The first and second data lines, respectively, receive the first and second data signals through a first end thereof; and the gate lines are sequentially scanned from a second end opposite to the first end.

According to the above, the first sub-pixel has the transmittance lower than that of the second sub-pixel, and the second sub-pixel connected to the i-th gate line is disposed between the first sub-pixel connected to the i-th gate line and the first sub-pixel connected to the (i+1)th gate line.

Thus, although the first sub-pixel connected to the (i+1)th gate line is relatively brighter than the other first sub-pixel, the black ghost phenomenon may be prevented from being seen by the naked eye since the first sub-pixel is disposed right adjacent to the area in which the high gray scale (or the intermediate gray scale) is displayed.

It is to be understood that both the foregoing general description and the following detailed description are exemplary and explanatory and are intended to provide further explanation of the invention as claimed.

BRIEF DESCRIPTION OF THE ILLUSTRATED EMBODIMENTS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Figure 1:
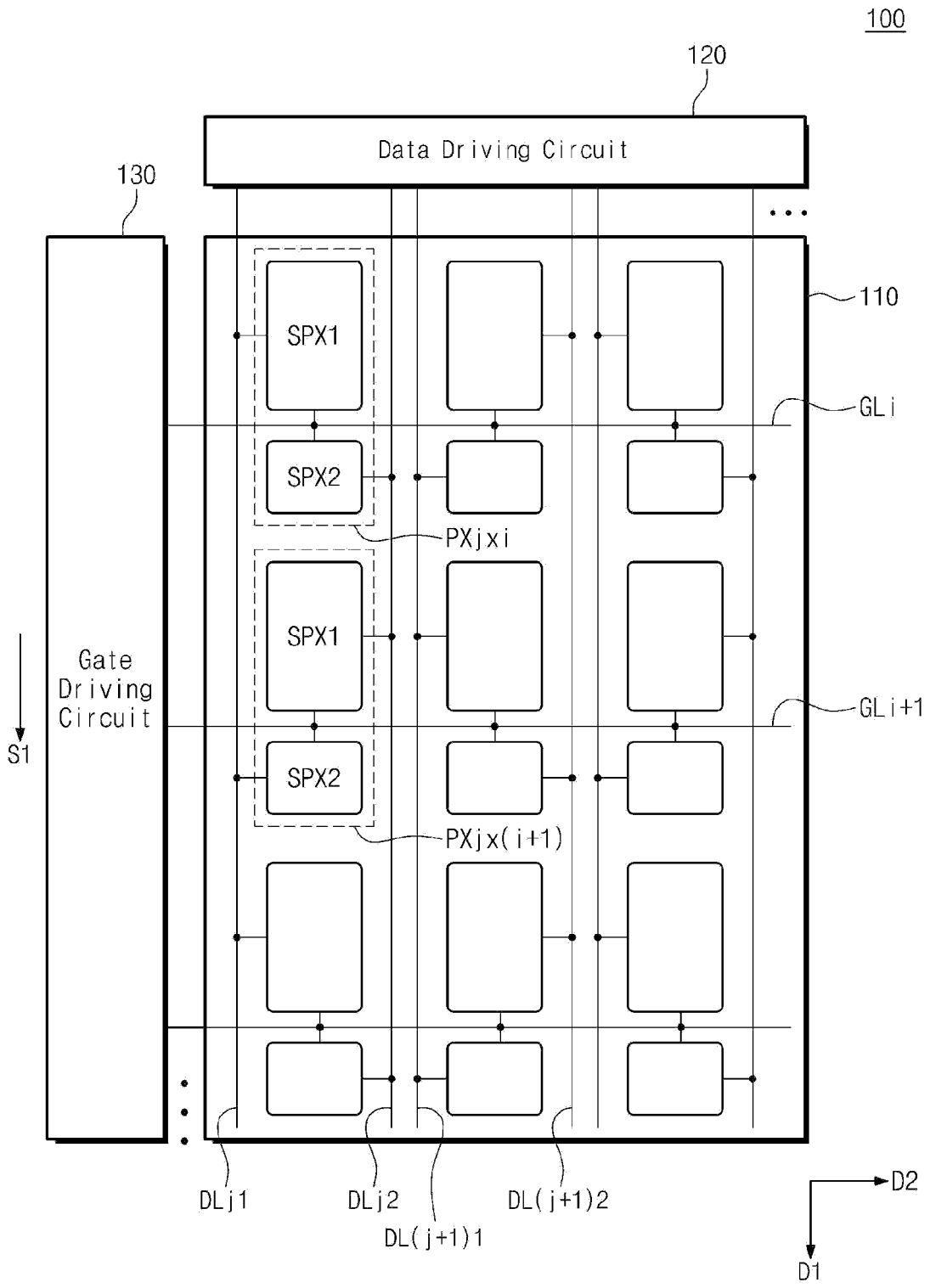
FIG. 1 is a block diagram showing a display apparatus according to an exemplary embodiment of the present invention.

It will be understood that when an element or layer is referred to as being "on", "connected to" or "coupled to"

another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
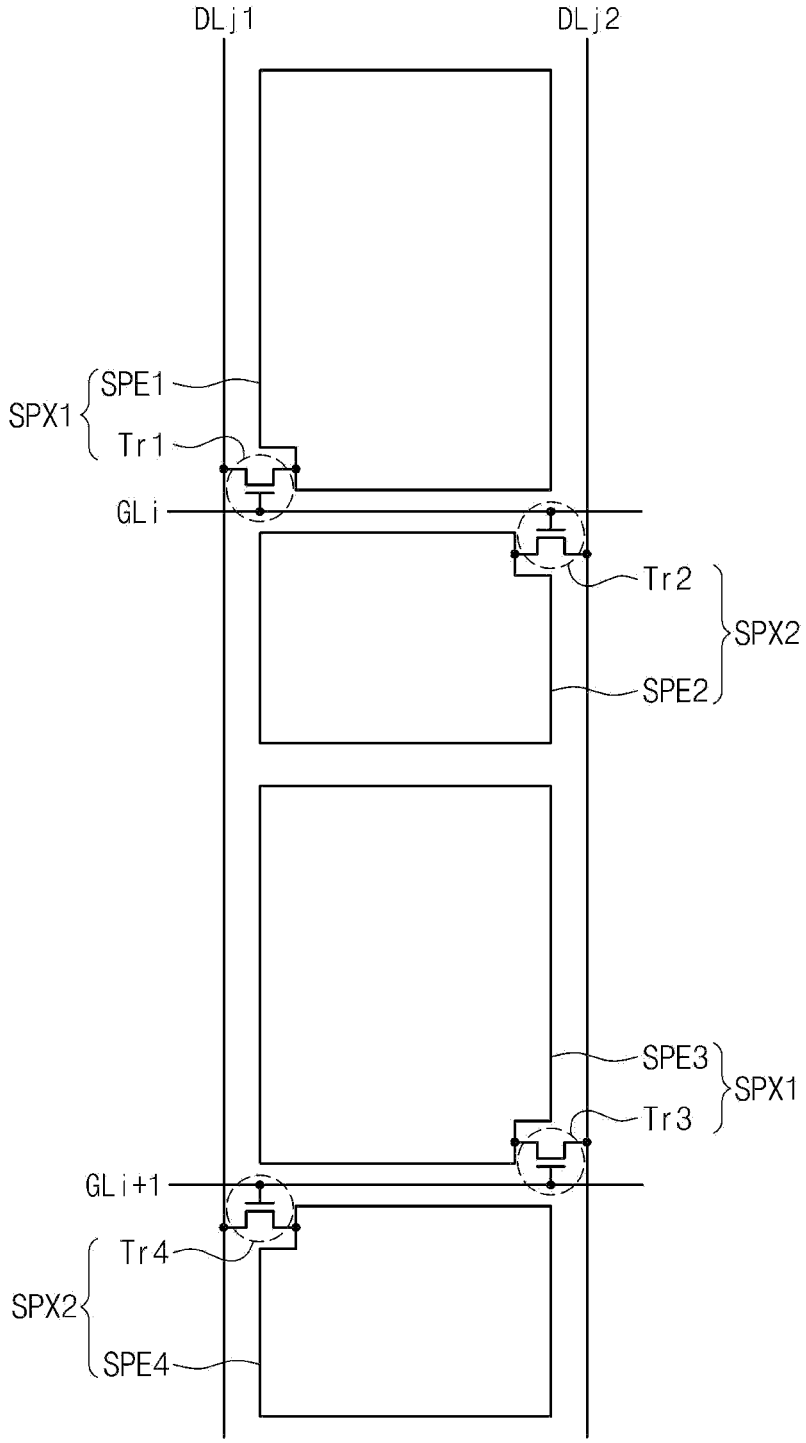
FIG. 2 is a circuit diagram showing part of a display panel shown in FIG. 1.

FIG. 1 is a block diagram showing a display apparatus according to an exemplary embodiment of the present disclosure and FIG. 2 is a circuit diagram showing a pixel of a display panel shown in FIG. 1.

Referring to FIG. 1, a display apparatus 100 includes a display panel 110 to display an image corresponding to a data signal and a gate signal. The display apparatus 100 includes a data driving circuit 120 to apply the data signal to the display panel 110, and a gate driving circuit 130 to apply the gate signal to the display panel 110.

The display panel 110 includes a plurality of data lines DLj1, DLj2, DL(j+1)1, and DL(j+1)2 and a plurality of gate lines GLi and GLi+1. The data lines DLj1, DLj2, DL(j+1)1, and DL(j+1)2 extend in a first direction D1 and are arranged substantially in parallel to each other. The gate lines GLi and GLi+1 extend in a second direction D2 substantially perpendicular to the data lines DLj1, DLj2, DL(j+1)1, and DL(j+1)2 and are arranged substantially in parallel to each other.

The data driving circuit 120 is connected to one of the ends of the data lines DLj1, DLj2, DL(j+1)1, and DL(j+1)2 and applies the data signal to the data lines DLj1, DLj2, DL(j+1)1, and DL(j+1)2. The gate driving circuit 130 is connected to one of the ends of the gate lines GLi and GLi+1 and applies the gate signal to the gate lines GLi and GLi+1.

The display panel 110 includes a plurality of pixels PXj×i and PXj×(i+1). Among the pixels PXj×i and PXj×(i+1), a first pixel PXj×i is connected to an i-th gate line GLi and a second pixel PXj×(i+1) is connected to an (i+1)th gate line GLi+1.

The pixels PXj×i and PXj×(i+1) are arranged in the same column and are disposed between two data lines DLj1 and DLj2 or DL(j+1)1 and DL(j+1)2. Two data lines DLj2 and DL(j+1) are disposed between two adjacent pixel columns. In detail, the first and second pixels PXj×i and PXj×(i+1) are included in a j-th pixel column and disposed between the first data line DLj1 and the second data line DLj2.

Each of the first and second pixels PXj×i and PXj×(i+1) includes first and second sub-pixels SPX1 and SPX2. The first and second sub-pixels SPX1 and SPX2 have different transmittances under the same gray scale. As an example, the first sub-pixel SPX1 has the transmittance lower than that of the second sub-pixel SPX2. The first and second sub-pixels SPX1 and SPX2 of the first pixel PXj×i are commonly connected to the i-th gate line GLi and the first and second sub-pixels SPX1 and SPX2 of the second pixel PXj×(i+1) are commonly connected to the (i+1)th gate line GLi+1.

The i-th gate line GLi is disposed between the first and second sub-pixels SPX1 and SPX2 of the first pixel PXj×i. The (i+1)th gate line GLi+1 is disposed between the first and second sub-pixels SPX1 and SPX2 of the second pixel PXj×(i+1). The second sub-pixel SPX2 connected to the i-th gate line GLi is disposed between the first sub-pixel SPX1 connected to the i-th gate line GLi and the first sub-pixel SPX1 connected to the (i+1)th gate line GLi+1.

The first sub-pixel SPX1 of the first pixel PXj×i is connected to the first data line DLj1 and the second sub-pixel SPX2 of the first pixel PXj×i is connected to the second data line DLj2. The first sub-pixel SPX1 of the second pixel PXj×(i+1) is connected to the second data line DLj2 and the second sub-pixel SPX2 of the second pixel PXj×(i+1) is connected to the first data line DLj.

The first and second data lines DLj1 and LDj2 are applied with the data signals having different polarities. For instance, when a positive data signal is applied to the first data line DLj1, a negative data signal is applied to the second data line DLj2. Accordingly, the first and second sub-pixels SPX1 and SPX2 may be applied with the data signals having different polarities.

In addition, as described above, the first sub-pixel SPX1 of the first pixel PXj×i and the first sub-pixel SPX1 of the second pixel PXj×(i+1) are applied with the data signals having the different polarities, and the second sub-pixel SPX2 of the first pixel PXj×i and the second sub-pixel SPX2 of the second pixel PXj×(i+1) are applied with the data signals having the different polarities. Therefore, units of sub-pixels may have inversed polarities.

The end of any one of the data lines DLj1, DLj2, DL(j+1)1, and DL(j+1)2 connected to the data driving circuit 120 and receiving the data signal is referred to as a first end and the other end opposite the first end is referred to as a second end. When a direction from the first end to the second end is referred to as a forward direction S1, the gate driving circuit 130 may sequentially scan the gate lines GLi and GLi+1 along the forward direction S1.

Referring to FIG. 2, which illustrates first pixel PXj×i, the first sub-pixel SPX1 of includes a first thin film transistor Tr1 and a first sub-pixel electrode SPE1. The second sub-pixel SPX2 of the first pixel PXj×i includes a second thin film transistor Tr2 and the second sub-pixel electrode SPE2. The first thin film transistor Tr1 includes a gate electrode connected to the i-th gate line GLi, a source electrode connected to the first data line DLj1 of the j-th data line, and a drain electrode connected to the first sub-pixel electrode SPE1. The second thin film transistor Tr2 includes a gate electrode connected to the i-th gate line GLi, a source electrode connected to the second data line DLj2 of the j-th data line, and a drain electrode connected to the second sub-pixel electrode SPE2.

The first sub-pixel electrode SPE1 is disposed at the first end side with reference to gate line GLi. The second sub-pixel electrode SPE2 is disposed at the second end side with reference to gate line GLi.

The first sub-pixel SPX1 of the second pixel PXj×(i+1) includes a third thin film transistor Tr3 and a third sub-pixel electrode SPE3 and the second sub-pixel SPX2 of the second pixel PXj×(i+1) includes a fourth thin film transistor Tr4 and the fourth sub-pixel electrode SPE4. The third thin film transistor Tr3 includes a gate electrode connected to the (i+1)th gate line GLi+1, a source electrode connected to the first data line DLj1 of the j-th data line, and a drain electrode connected to the third sub-pixel electrode SPE3. The fourth thin film transistor Tr4 includes a gate electrode connected to the (i+1) th gate line GLi+1, a source electrode connected to the second data line DLj2 of the j-th data line, and a drain electrode connected to the fourth sub-pixel electrode SPE4.

The third sub-pixel electrode SPE3 is disposed at the first end side with reference to gate line GLi+1 and the fourth sub-pixel electrode SPE4 is disposed at the second end side with respect to gate line GLi+1. Thus, the second sub-pixel electrode SPE2 is disposed between the first and third sub-pixel electrodes SPE1 and SPE3.

Figure 3:
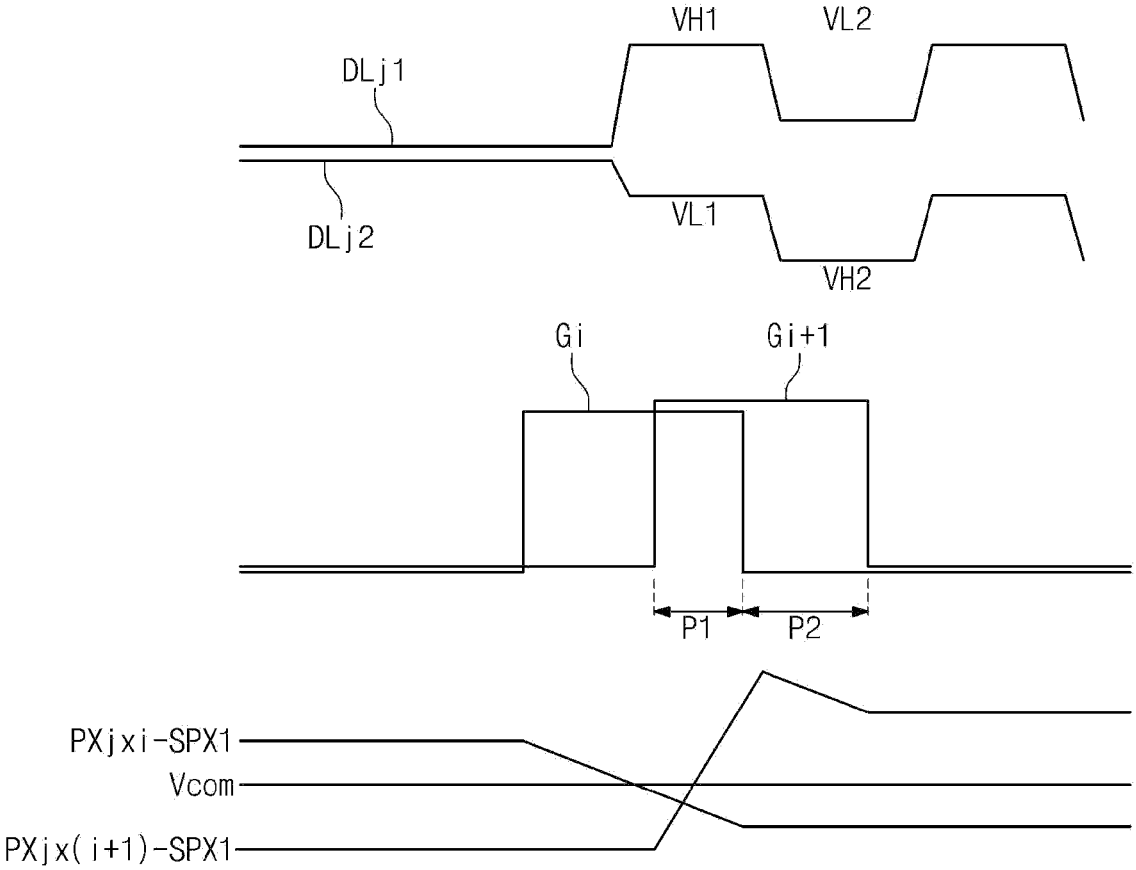
FIG. 3 is a waveform diagram explaining a pre-charging process of a display panel shown in FIG. 1.
Figure 4:
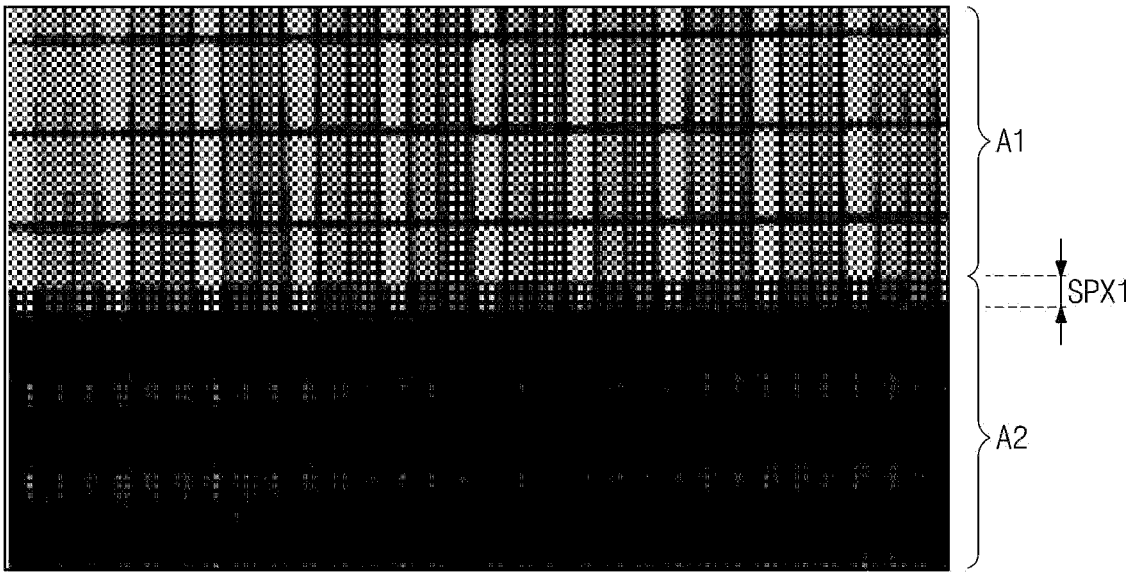
FIG. 4 is a view showing a gray scale converted from a high gray scale (or an intermediate gray scale) to a low gray scale of a display panel shown in FIG. 1.

FIG. 3 is a waveform diagram explaining a pre-charging process, and FIG. 4 is a view showing a gray scale converted from a high gray scale (or an intermediate gray scale) to a low gray scale.

Referring to FIG. 3, an i-th gate signal Gi is applied to the i-th gate line, GLi, and an (i+1)th gate signal Gi+1 is applied to the (i+1)th gate line, GLi+1. A high period of the i-th gate signal, Gi, may partially overlap a high period of the (i+1)th gate signal, Gi+1. That is, a pre-charging period P1, in which the i-th gate signal Gi and the (i+1)th gate signal Gi+1 are substantially simultaneously maintained in the high period, exists.

During the pre-charging period P1, the first data signal (hereinafter referred to as a first low voltage having a first transmittance) applied to the first data line DLj1 is applied to the first sub-pixel SPX1 of the first pixel PXj×i connected to the i-th gate line Gi, and the second data signal (hereinafter, referring to as a first high voltage having a second transmittance) applied to the second data line DLj2 is applied to the second sub-pixel SPX2 of the first pixel PXj×i. The first transmittance is lower than the second transmittance and the first low voltage has an absolute value higher than that of the first high voltage, with respect to a reference voltage Vcom.

During the pre-charging period P1, the second sub-pixel SPX2 of the second pixel PXj×(i+1) is pre-charged with the first low voltage applied to the first data line DLj1 and the first sub-pixel SPX1 of the second pixel PXj×(i+1) is pre-charged with the first high voltage applied to the second data line DLj2.

Then, during a main-charging period P2 of the (i+1)th gate line GLi+1, the second sub-pixel SPX2 of the second pixel PXj×(i+1) is main-charged with a second high voltage applied to the first data line DLj1, and the first sub-pixel SPX1 of the second pixel PXj×(i+1) is main-charged with a second low voltage.

As shown in FIGS. 3 and 4, when the first pixel PXj×i connected to the i-th gate line GLi is a pixel arranged in a last row of a first area A1, in which the high gray scale (or the intermediate gray scale) may be displayed, and the second pixel PXj×(i+1) connected to the (i+1)th gate line GLi+1 is a pixel arranged in a first row of a second area A2, in which the low gray scale is displayed, the first sub-pixel SPX1 of the second pixel PXj×(i+1) is pre-charged with the first high voltage higher than the second low voltage. During the main-charging period P2, the first high voltage comes down to the second low voltage, but an black ghost phenomenon may occur, in which the first sub-pixel SPX1 of the second pixel PXj×(i+1) is relatively brighter than the other first sub-pixel PXj×i-SPX1 of the low gray scale.

However, the first sub-pixel SPX1 of the second pixel PXj×(i+1) is disposed closer to the first pixel PXj×i than the second sub-pixel SPX2 of the second pixel PXj×(i+1). Accordingly, although the first sub-pixel SPX1 of the second pixel PXj×(i+1) is brighter than the other first sub-pixel PXj×i-SPX1 of the low gray scale, the black ghost phenomenon may be prevented from being seen by the naked eye since the first sub-pixel SPX1 of the second pixel PXj×(i+1) is disposed adjacent to the first area A1 in which the high gray scale (or the intermediate gray scale) is displayed.

Figure 5:
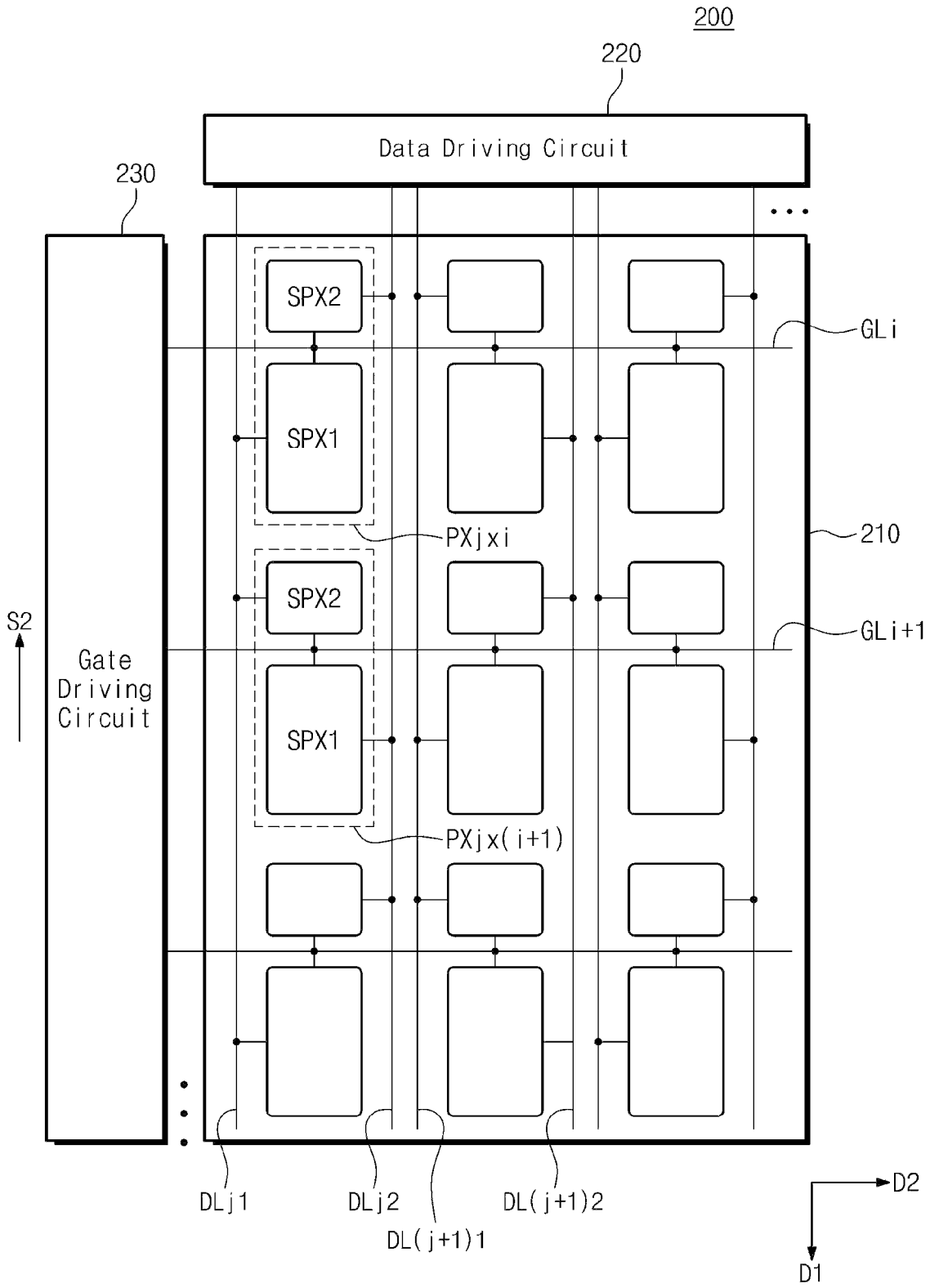
FIG. 5 is a block diagram showing a display apparatus according to another exemplary embodiment of the present invention.
Figure 6:
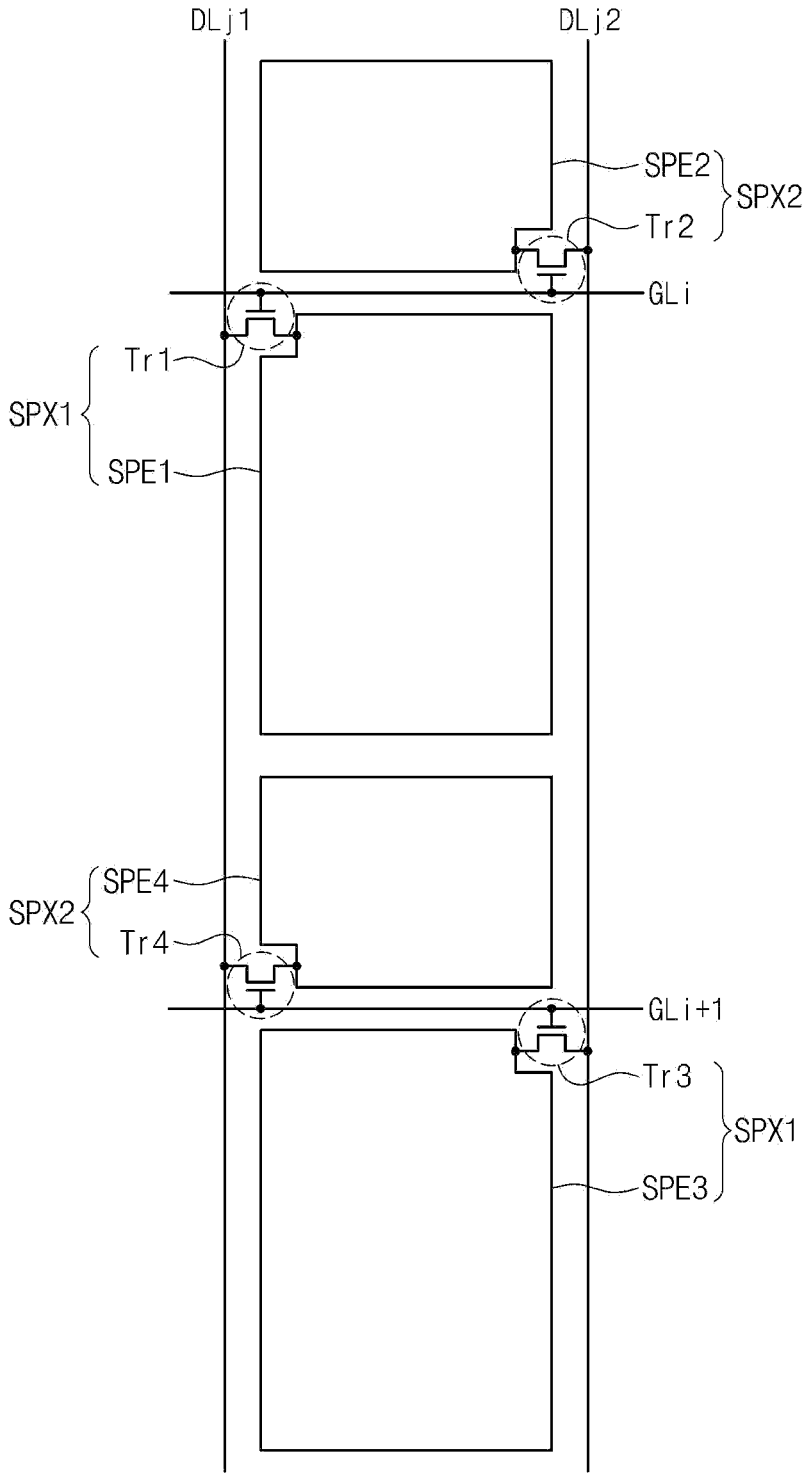
FIG. 6 is a circuit diagram showing the pixel of a display panel shown in FIG. 5.

FIG. 5 is a block diagram showing a display apparatus according to another exemplary embodiment of the present disclosure and FIG. 6 is a circuit diagram showing a pixel of a display panel shown in FIG. 5.

Referring to FIG. 5, a display apparatus 200 includes a display panel 210 to display an image corresponding to a data signal in response to a gate signal, a data driving circuit 220 to apply the data signal to the display panel 210, and a gate driving circuit 230 to apply the gate signal to the display panel 210.

The display panel 210 includes a plurality of data lines DLj1, DLj2, DL(j+1)1, and DL(j+1)2 and a plurality of gate lines GLi and GLi+1. The data driving circuit 220 is connected to an end of each of the data lines DLj1, DLj2, DL(j+1)1, and DL(j+1)2, and applies the data signal to the data lines DLj1, DLj2, DL(j+1)1, and DL(j+1)2. The gate driving circuit 230 is connected to one end of each of the the gate lines GLi and GLi+1.

Among the data lines DLj1, DLj2, DL(j+1)1, and DL(j+1)2, the end connected to the data driving circuit 220 and receiving the data signal is referred to as a first end and the other end opposite to the end is referred to as a second end. When the direction from the first end to the second end is referred to as the forward direction S1 (refer to FIG. 1) and a direction from the second end to the first end is referred to as a reverse direction S2, the gate driving circuit 230 may sequentially scan the gate lines GLi and GLi+1 along the reverse direction S2.

Referring to FIG. 6, the first sub-pixel SPX1 of the first pixel PXj×i includes a first thin film transistor Tr1 and a first sub-pixel electrode SPE1. The second sub-pixel SPX2 of the first pixel PXj×i includes a second thin film transistor Tr2 and the second sub-pixel electrode SPE2. The first thin film transistor Tr1 includes a gate electrode connected to the i-th gate line GLi, a source electrode connected to the first data line DLj1 of the j-th data line, and a drain electrode connected to the first sub-pixel electrode SPE1. The second thin film transistor Tr2 includes a gate electrode connected to the i-th gate line GLi, a source electrode connected to the second data line DLj2 of the j-th data line, and a drain electrode connected to the second sub-pixel electrode SPE2.

The first sub-pixel electrode SPE1 is disposed at the second end side with reference to gate line GLi and the second sub-pixel electrode SPE2 is disposed at the first end side with reference to gate line GLi.

The first sub-pixel SPX1 of the second pixel PXj×(i+1) includes a third thin film transistor Tr3 and a third sub-pixel electrode SPE3. The second sub-pixel SPX2 of the second pixel PXj×(i+1) includes a fourth thin film transistor Tr4 and the fourth sub-pixel electrode SPE4. The third thin film transistor Tr3 includes a gate electrode connected to the (i+1)th gate line GLi+1, a source electrode connected to the second data line DLj2, and a drain electrode connected to the third sub-pixel electrode SPE3. The fourth thin film transistor Tr4 includes a gate electrode connected to the (i+1)th gate line GLi+1, a source electrode connected to the first data line DLj1 of the j-th data line, and a drain electrode connected to the fourth sub-pixel electrode SPE4.

The third sub-pixel electrode SPE3 is disposed at the second end side with reference to gate line GLi+1 and the fourth sub-pixel electrode SPE4 is disposed at the first end side with reference to gate line GLi+1. Thus, the first sub-pixel electrode SPE1 is disposed between the second and fourth sub-pixel electrodes SPE2 and SPE4.

Figure 7:
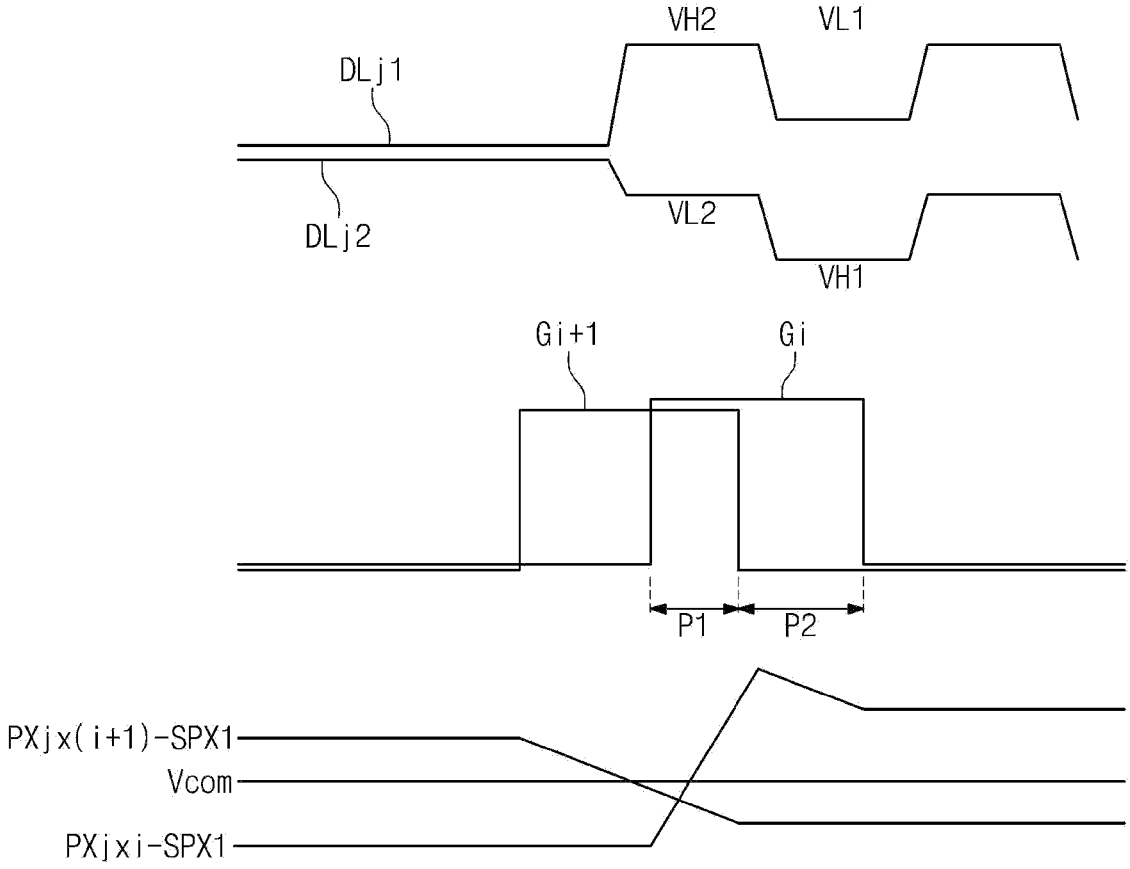
FIG. 7 is a waveform diagram explaining a pre-charging process of a display panel shown in FIG. 5.
Figure 8:
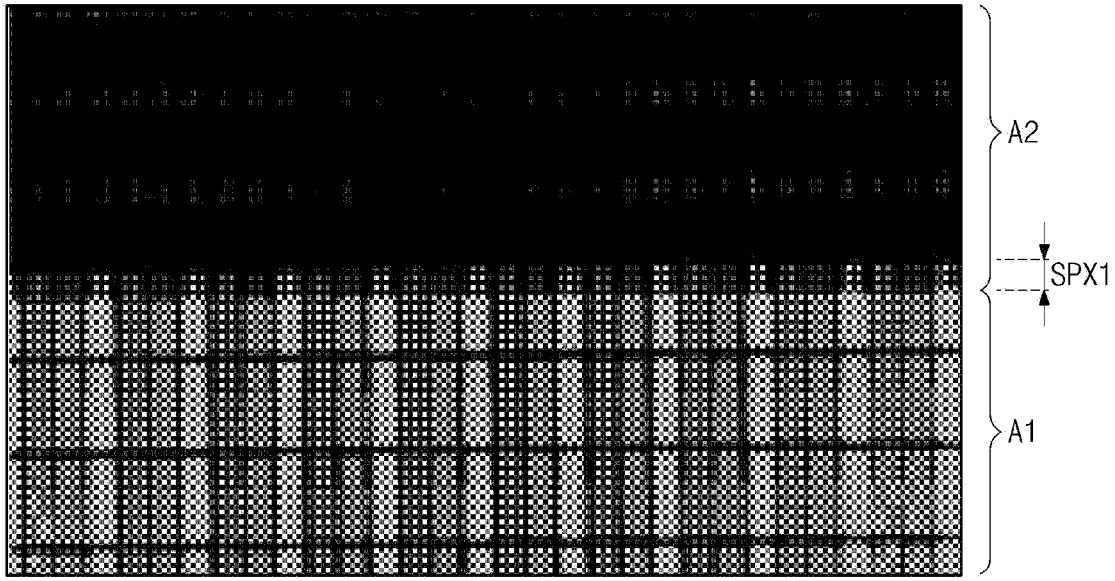
FIG. 8 is a view showing a gray scale converted from a high gray scale to a low gray scale of a display panel shown in FIG. 5.

FIG. 7 is a waveform diagram explaining a pre-charging process and FIG. 8 is a view showing a gray scale converted from a high gray scale to a low gray scale.

Referring to FIG. 7, an i-th gate signal Gi is applied to the i-th gate line GLi and an (i+1)th gate signal Gi+1 is applied to the (i+1)th gate line GLi+1. A high period of the i-th gate signal Gi may partially overlap a high period of the (i+1)th gate signal Gi+1. In this case, a period when the i-th gate signal Gi and the (i+1)th gate signal Gi+1 are substantially simultaneously maintained in the high period, is referred to as a pre-charging period P1.

During the pre-charging period P1, a second low voltage VL2 applied to the first data line DLj1 is applied to the first sub-pixel SPX1 of the second pixel PXj×(i+1) and a second high voltage VH2 applied to the second data line DLj2 is applied to the second sub-pixel SPX2 of the first pixel PXj×(i+1).

During the pre-charging period P1, the second sub-pixel SPX2 of the first pixel PXj×i is pre-charged with the second low voltage VL2 applied to the first data line DLj1. The first sub-pixel SPX1 of the first pixel PXj×i is pre-charged with the second high voltage VH2 applied to the second data line DLj2.

Then, during a main-charging period P2 of the i-th gate line GLi, the second sub-pixel SPX2 of the first pixel PXj×i is main-charged with a first high voltage VH1 applied to the first data line DLj1 and the first sub-pixel SPX1 of the first pixel PXj×i connected to the i-th gate line GLi is main-charged with a first low voltage VL1.

When the second pixel PXj×(i+1) displays the high gray scale and the first pixel PXj×i c displays the low gray scale, the first sub-pixel SPX1 of the first pixel PXj×i is precharged with the second high voltage VH2, which is higher than the first low voltage VH1.

During the main-charging period P2, the second high voltage VH2 diminishes to the level of first low voltage VL1, but a black ghost phenomenon occurs, in which the first sub-pixel SPX1 of the first pixel PXj×i is relatively brighter than the other first sub-pixel PXj×(i+1)–SPX1 of the low gray scale.

However, the first sub-pixel SPX1 of the first pixel PXj×i is disposed closer to the second pixel PXj×(i+1) than the second sub-pixel SPX2 of the second pixel PXj×(i+1). Accordingly, although the first sub-pixel SPX1 of the first pixel PXj×i is brighter than the other first sub-pixel PXj×(i+1)–SPX1 of the low gray scale, the black ghost phenomenon may be prevented from being seen by the naked eye since the first sub-pixel SPX1 of the first pixel PXj×i is disposed right adjacent to the first area A1 in which the high gray scale (or the intermediate gray scale) is displayed.

Figure 9:
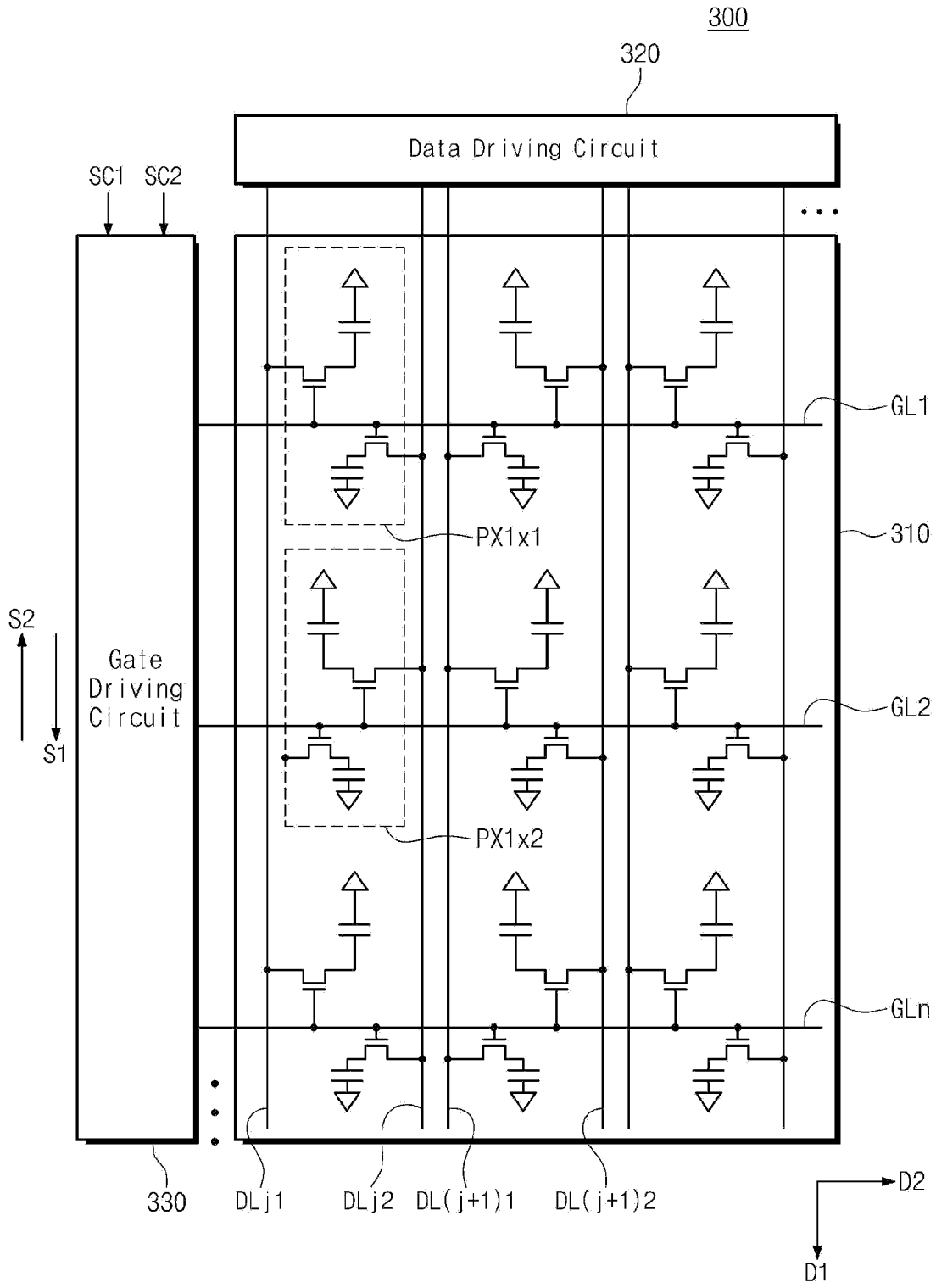
FIG. 9 is a block diagram showing a display apparatus according to another exemplary embodiment of the present invention.
Figure 10:
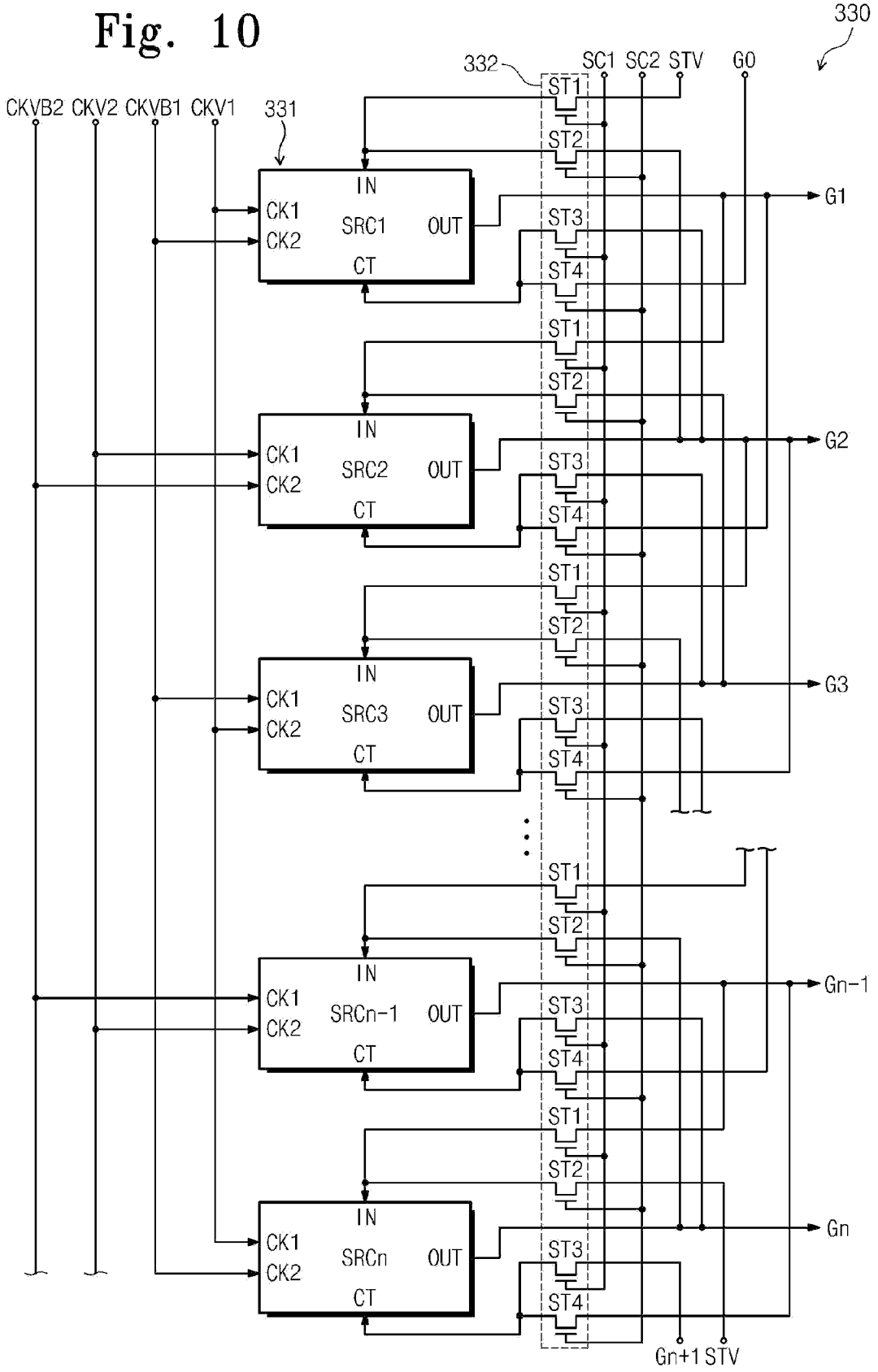
FIG. 10 is a block diagram showing a gate driving circuit shown in FIG. 9.

FIG. 9 is a block diagram showing a display apparatus according to another exemplary embodiment of the present disclosure and FIG. 10 is a block diagram showing a gate driving circuit shown in FIG. 9.

Referring to FIG. 9, a display apparatus 300 includes a gate driving circuit 330 that performs the scanning operation along the forward direction S1 or the reverse direction S2. The first ends of the data lines DLj1, DLj2, DL(j+1)1, and DL(j+1)2 are connected to a data driving circuit 320 to receive the data signal. An opposite end of the data lines DLj1, DLj2, DL(j+1)1, and DL(j+1)2 to the first end is referred to as the second end. The forward direction S1 may be the direction traveling to the second end from the first end and the reverse direction S2 may be the direction traveling to the first end from the second end. The display panel of FIG. 9 may be structured like the display panel of FIG. 1 or the display panel of FIG. 5.

The gate driving circuit 330 performs the scanning operation along the forward direction S1 or the reverse direction S2 in response to first and second scan selection signals SC1 and SC2.

In detail, when the first scan selection signal SC1 is applied to the gate driving circuit 330, the gate driving circuit 330 performs the scanning operation along the forward direction 51 to sequentially apply the gate signal to the first gate line GL1 to the n-th gate line GLn. When the second scan selection signal SC2 is applied to the gate driving circuit 330, the gate driving circuit 330 performs the scanning operation along the reverse direction S2 to sequentially apply the gate signal to the n-th gate line GLn to the first gate line GL1.

As an example, the first and second scan selection signals SC1 and SC2 may be provided from a timing controller (not shown) disposed on the display apparatus 300 to control the operation of the gate driving circuit 330 and the data driving circuit 320.

As described above, since the direction, along which the scanning operation of the gate driving circuit 330 is performed, may be selectively determined, the display apparatus 300 may display the image to a desired direction.

Referring to FIG. 10, the gate driving circuit 330 includes a shift register 331 and a scan direction selector 332.

The shift register 331 includes a plurality of stages SRC1 to SRCn connected to each other one after another. Each stage includes an input terminal IN, a control terminal CT, a first clock terminal CK1, a second clock terminal CK2, and an output terminal OUT. The input terminal IN receives either a previous stage gate signal from a previous stage or a next stage gate signal from a next stage. In addition, the control terminal CT receives either the next stage gate signal from the next stage or the previous stage gate signal from the previous stage. The gate signal is output from the output terminal OUT.

The first clock terminal CK1 receives one of first, second, third, and fourth clock signals CKV1, CKV2, CKVB1, and CKVB2 and the second clock terminal CK2 receives another of the first, second, third, and fourth clock signals CKV1, CKV2, CKVB1, and CKVB2, which is different from the one clock applied to the first clock terminal CK1. In detail, the first and third clock signals CKV1 and CKVB1 are applied to the first and second clock terminals CK1 and CK2 of odd-numbered stages SRC1, SRC3, . . . , SRCn−1 of the stages SRC1 to SRCn. The second and fourth clock signals CKV2 and CKVB2 are applied to the first and second clock terminals CK1 and CK2 of even-numbered stages SRC2, . . . , SRCn of the stages SRC1 to SRCn.

As an example, the first and third clock signals CKV1 and CKVB1 have opposite phases to each other and the second and fourth clock signals CKV2 and CKVB2 have opposite phases to each other. In addition, a phase difference exists between the second clock signal CKV2 and the first clock signal CKV1. Due to the phase difference between the first and second clock signals CKV1 and CKV2, the pre-charging period P2 (refer to FIGS. 3 and 6) is determined.

The scan direction selector 332 includes first, second, third, and fourth switching transistor ST1, ST2, ST3, and ST4, respectively.

The first switching transistor ST1 applies the pervious stage gate signal to the input terminal IN of each stage in response to the first scan selection signal SC1. The second switching transistor ST2 applies the next stage gate signal to the input terminal IN of each stage in response to the second scan selection signal SC2. The first and second scan selection signals SC1 and SC2 have opposite phases to each other.

The third switching transistor ST3 applies the next stage gate signal to the control terminal CT of each stage in response to the first scan selection signal SC1. The fourth switching transistor ST4 applies the previous stage gate signal to the control terminal CT of each stage in response to the second scan selection signal SC2.

Figure 11:
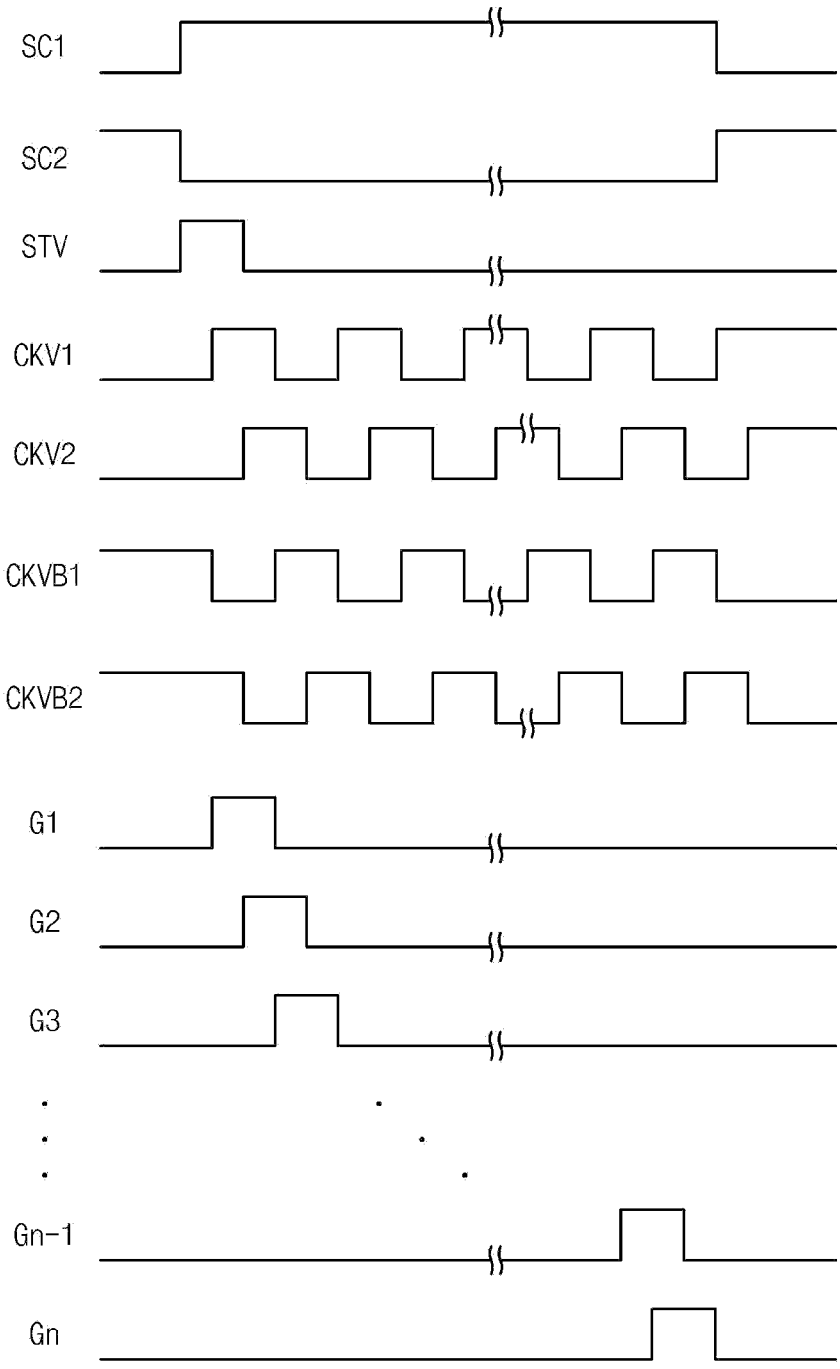
FIG. 11 is a waveform diagram showing gate signals applied to gate lines when the gate driving circuit is driven in a forward direction.
Figure 12:
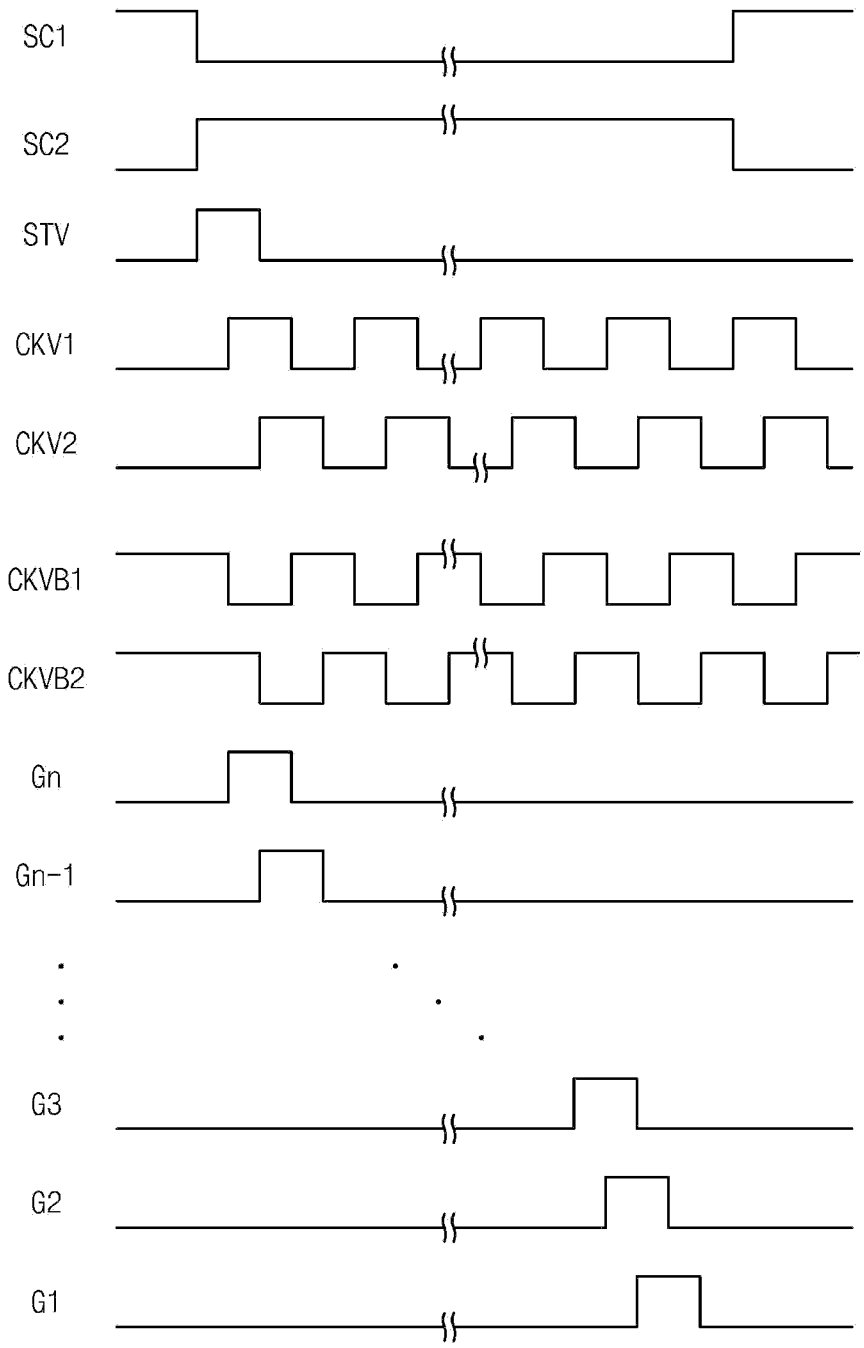
FIG. 12 is a waveform diagram showing gate signals applied to gate lines when the gate driving circuit is driven in a reverse direction.

FIG. 11 is a waveform diagram showing gate signals applied to gate lines when the gate driving circuit is driven in a forward direction and FIG. 12 is a waveform diagram showing gate signals applied to gate lines when the gate driving circuit is driven in a reverse direction.

Referring to FIG. 11, when the gate driving circuit 330 starts the scanning operation in the forward direction S1 in response to the first scan selection signal SC1, the gate signal is applied to the input terminal IN of each of the stages SRC1 to SRCn from the previous stage of each stage and the gate signal is applied to the control terminal CT of each of the stages SRC1 to SRCn from the next stage of each stage. Therefore, the stages SRC1 to SRCn are sequentially operated from the first stage SRC1 to the n-th stage SRCn and sequentially output the first to n-th gate signals G1 to Gn, thereby performing the scanning operation in the forward direction S1.

As shown in FIG. 10, a start signal STV is applied to the input terminal IN of the first stage SRC1 instead of the gate signal of the previous stage. Although not shown in figures, the shift register 131 may further include a first dummy stage to apply the gate signal Gn+1 of the next stage to the n-th stage SRCn.

Referring to FIG. 12, when the gate driving circuit 330 starts the scanning operation in the reverse direction S2 in response to the second scan selection signal SC2, the gate signal is applied to the input terminal IN of each of the stages SRC1 to SRCn from the next stage of each stage and the gate signal is applied to the control terminal CT of each of the stages SRC1 to SRCn from the previous stage of each stage. Therefore, the stages SRC1 to SRCn are sequentially operated from the n-th stage SRCn to the first stage SRC1 and sequentially output the n-th to first gate signals Gn to G1, thereby performing the scanning operation in the reverse direction S2.

As shown in FIG. 10, a start signal STV is applied to the input terminal IN of the n-th stage SRCn instead of the gate signal of the previous stage. Although not shown in figures, the shift register 131 may further include a second dummy stage to apply the gate signal Gn+1 of the next stage to the first stage SRC1.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus, comprising:

a plurality of pixels, each of the plurality of pixels comprising a first sub-pixel and a second sub-pixel having different transmittances from each other under the same gray scale;

a plurality of gate lines, each of the plurality of gate lines electrically connected to the first and second sub-pixels to apply a gate signal to the first and second sub-pixels;

a first data line that applies a first data signal to one of the first and second sub-pixels; and a second data line to apply a second data signal to the other one of the first and the second sub-pixels, wherein:

the transmittance of the first sub-pixel is lower than the transmittance of the second sub-pixel, and the second sub-pixel electrically connected to an i-th gate line of the gate lines is disposed between the first sub-pixel electrically connected to the i-th gate line and the first sub-pixel electrically connected to an (i+1)th gate line of the gate lines.

2. The display apparatus of claim 1, wherein the first sub-pixel electrically connected to the i-th gate line and the second sub-pixel electrically connected to the (i+1)th gate line are electrically connected to the first data line, and the second sub-pixel electrically connected to the i-th gate line and the first sub-pixel electrically connected to the (i+1)th gate line are electrically connected to the second data line.

3. The display apparatus of claim 2, wherein the first and second data lines receive the first and second data signals, respectively, through a first end of the first and second data lines, and the gate lines are sequentially scanned from the first end to a second end opposite the first end.

4. The display apparatus of claim 3, wherein a high period of an i-th gate signal applied to the i-th gate line partially overlaps a high period of an (i+1)th gate signal applied to the (i+1)th gate line.

5. The display apparatus of claim 4, wherein the overlapping period of the high period of the (i+1)th gate signal is a pre-charging period and a remaining period of the high period of the (i+1)th gate line is a main-charging period.

6. The display apparatus of claim 3, wherein the i-th gate line is disposed between the first and second sub-pixels electrically connected to the i-th gate line.

7. The display apparatus of claim 6, wherein the first sub-pixel electrically connected to the i-th gate line is disposed at the first end side with reference to the i-th gate line, the second sub-pixel electrically connected to the i-th gate line is disposed at the second end side with reference to the i-th gate line, the first sub-pixel electrically connected to the (i+1)th gate line is disposed at the first end side with reference to the (i+1)th gate line, and the second sub-pixel electrically connected to the (i+1)th gate line is disposed at the second end side with reference to the (i+1)th gate line.

8. The display apparatus of claim 1, wherein the first sub-pixel comprises a first thin film transistor and a first sub-pixel electrode electrically connected to the first thin film transistor, and the second sub-pixel comprises a second thin film transistor and a second sub-pixel electrode electrically connected to the second thin film transistor.

9. The display apparatus of claim 1, wherein the first data signal has a polarity opposite to a polarity of the second data signal.

10. A display apparatus, comprising:

a plurality of pixels, each of the plurality of pixels comprising a first sub-pixel and a second sub-pixel having different transmittances from each other under the same gray scale;

a plurality of gate lines, each of the plurality of gate lines electrically connected to the first and second sub-pixels to apply a gate signal to the first and the second sub-pixels;

a first data line that applies a first data signal to one of the first and second sub-pixels; and a second data line that applies a second data signal to the other one of the first and second sub-pixels, wherein:

the transmittance of the first sub-pixel is lower than the transmittance of the second sub-pixel, the first sub-pixel electrically connected to an i-th gate line of the gate lines is disposed between the second sub-pixel electrically connected to the i-th gate line and the second sub-pixel electrically connected to an (i+1)th gate line, and the first and second data lines receive the first and second data signals through a first end of the first and second data lines, respectively.

11. The display apparatus of claim 10, wherein the first sub-pixel electrically connected to the i-th gate line and the second sub-pixel electrically connected to the (i+1)th gate line are electrically connected to the first data line, and the second sub-pixel electrically connected to the i-th gate line and the first sub-pixel electrically connected to the (i+1)th gate line are electrically connected to the second data line.

12. The display apparatus of claim 10, wherein a high period of an i-th gate signal applied to the i-th gate line partially overlaps a high period of an (i+1)th gate signal applied to the (i+1)th gate line.

13. The display apparatus of claim 12, wherein the overlapped period of the high period of the i-th gate signal is a pre-charging period and a remaining period of the high period of the i-th gate line is a main-charging period.

14. The display apparatus of claim 11, wherein the i-th gate line is disposed between the first and second sub-pixels electrically connected to the i-th gate line.

15. The display apparatus of claim 14, wherein the second sub-pixel electrically connected to the i-th gate line is disposed at the first end side with reference to the i-th gate line, the first sub-pixel electrically connected to the i-th gate line is disposed at the second end side with reference to the i-th gate line, the second sub-pixel electrically connected to the (i+1)th gate line is disposed at the first end side with reference to the (i+1)th gate line, and the first sub-pixel electrically connected to the (i+1)th gate line is disposed at the second end side with reference to the (i+1)th gate line.

16. The display apparatus of claim 10, wherein the first sub-pixel comprises a first thin film transistor and a first sub-pixel electrode electrically connected to the first thin film transistor, and the second sub-pixel comprises a second thin film transistor and a second sub-pixel electrode electrically connected to the second thin film transistor.

17. The display apparatus of claim 10, wherein the first data signal has a polarity opposite to a polarity of the second data signal.

18. The display apparatus of claim 10, wherein the gate driving circuit comprises:

a shift register comprising a plurality of stages electrically connected to each other one in succession and sequentially outputs the gate signal along a scan direction; and a scan direction selector that selects the scan direction of the shift register.

19. The display apparatus of claim 18, wherein each of the stages comprises:

an input terminal that receives the gate signal from a previous stage or the gate signal from a next stage;

a control terminal that receives the gate signal from the next stage or the gate signal from the previous stage; and an output terminal that outputs the gate signal.

20. The display apparatus of claim 19, wherein the scan direction selector comprises:

a first switching transistor that applies the gate signal of the previous stage to the input terminal in response to a first scan selection signal;

a second switching transistor that applies the gate signal of the next stage to the input terminal in response to a second scan selection signal;

a third switching transistor that applies the gate signal of the next stage to the control terminal in response to the first scan selection signal; and a fourth switching transistor that applies the gate signal of the previous stage to the control terminal in response to the second scan selection signal.

* * * * *